US008823251B2

(12) United States Patent
Hwang et al.

(10) Patent No.: US 8,823,251 B2
(45) Date of Patent: Sep. 2, 2014

(54) PARTIAL SHROUD OF SPARK PLUG FOR GROUND ELECTRODE HEAT DISPERSION

(75) Inventors: Jeongung Hwang, Northville, MI (US); Nicholas C. Polcyn, Commerce, MI (US); Christopher Thomas, Oakland, MI (US)

(73) Assignees: DENSO International America, Inc., Southfield, MI (US); Denso Corporation, Kariya-shi, Aichi-ken (JP)

( * ) Notice: Subject to any disclaimer, the term of this patent is extended or adjusted under 35 U.S.C. 154(b) by 21 days.

(21) Appl. No.: 13/542,852

(22) Filed: Jul. 6, 2012

(65) Prior Publication Data

US 2014/0009058 A1 Jan. 9, 2014

(51) Int. Cl.
*H01T 13/20* (2006.01)

(52) U.S. Cl.
USPC ..... 313/141; 313/118; 313/143

(58) Field of Classification Search
USPC ..... 313/118, 141, 142, 143, 144, 145
See application file for complete search history.

(56) References Cited

U.S. PATENT DOCUMENTS

| | | | | |
|---|---|---|---|---|
| 4,268,774 | A | 5/1981 | Forkum, Jr. | |
| 5,091,672 | A | 2/1992 | Below | |
| 5,461,276 | A * | 10/1995 | Matsutani et al. | 313/141 |
| 5,950,584 | A | 9/1999 | Bubeck | |
| 6,198,209 | B1 | 3/2001 | Baldwin et al. | |
| 6,628,050 | B1 * | 9/2003 | Kameda et al. | 313/143 |
| 7,652,413 | B2 | 1/2010 | Kawashima | |
| 2007/0252503 | A1 | 11/2007 | Rossi | |
| 2008/0100193 | A1 * | 5/2008 | Takeuchi et al. | 313/141 |
| 2012/0299458 | A1 | 11/2012 | Aochi et al. | |

FOREIGN PATENT DOCUMENTS

JP 2012-248389 12/2012

* cited by examiner

*Primary Examiner* — Britt D Hanley
*Assistant Examiner* — Kevin Quarterman
(74) *Attorney, Agent, or Firm* — Harness, Dickey & Pierce, P.L.C.

(57) ABSTRACT

A spark plug for use with internal combustion engines includes a metallic shell housing having a semi-cylindrical shroud partially surrounding the insulator and the center electrode and to which the ground electrode is joined. The semi-cylindrical shroud promotes improved heat dissipation from the ground electrode to the shell housing.

20 Claims, 6 Drawing Sheets

PARTIAL SHROUD OF SPARK PLUG FOR GROUND ELECTRODE HEAT DISPERSION

FIELD

The present disclosure relates generally to spark plugs for use in internal construction engines and, more particularly, to a spark plug having a partial shroud for improved ground electrode heat dispersion.

BACKGROUND

This section provides background information related to the present disclosure which is not necessarily prior art.

Conventional spark plugs for use in internal combustion engines generally include metal shell housing, a ceramic insulator, a center electrode, and a ground electrode. The shell housing has a threaded portion for locating an end portion of the spark plug in a combustion chamber of the engine. The insulator is fixed in the shell housing such that an end of the insulator protrudes from an end of the shell housing. The center electrode is secured in a center bore of the insulator such that a tip end of the center electrode protrudes from the end of the insulator. The ground electrode is fixed to the shell housing and has a side surface that is opposed to and spaced from the tip end of the center electrode so as to form a spark gap therebetween. By applying a high voltage across the center electrode and the ground electrode, a spark discharge takes place within the spark gap, thereby igniting the air-fuel mixture within the combustion chamber.

Spark plug technology for gasoline engines continues to develop in an effort to promote higher performance and longer service life. Following this trend, gasoline engines have also continued to develop as fuel economy and emission standards have advanced. As a result, lean burn engines now create higher combustion chamber temperatures which can directly influence spark plug performance, specifically ignitability and heat dispersion away from the ground electrode. To avoid engine damage from pre-ignition events and alleviate durability concerns, it is known that combustion chamber temperatures exceeding the ground electrode threshold must be kept to a minimum.

In an effort to address these concerns, "shrouded" spark plugs have been used in some severe engine environments to assist in dissipating heat away from the ground electrode. The concept of a shroud-type spark plug is based upon joining a shortened ground electrode to a cylindrical collar that is fixed to the shell housing and configured to completely surround the center electrode as well as some or all of the ground electrode. This shrouded shell housing configuration creates higher heat conductivity which promotes quicker heat mass transfer to the shell housing and away from the ground electrode. While shroud-type spark plugs assist in promoting improved cooling of the ground electrode, they have a negative effect on the optimal tumble pattern for the air-fuel mixture around and within the sparking area which can result in lower ignitability and less complete combustion.

Accordingly, as engine technology continues to advance, a need exists to continue development of advanced spark plug technologies directed to improved heat dissipation from the ground electrode while maintaining high ignitability for a complete burn and ensuring a long service life.

SUMMARY

This section provides a general summary of the disclosure, and is not a comprehensive disclosure of its full scope or all of its features and advantages.

It is an aspect of the present disclosure to provide a partially-shrouded spark plug which addresses and overcomes the shortcomings of prior art spark plugs. In particular, the partially-shrouded spark plug of the present disclosure addresses ground electrode temperature reduction requirements while promoting a better air-fuel mixture tumble pattern around and within the sparking area for higher ignitability and more complete combustion.

In accordance with this and other aspects of the present disclosure, a spark plug is provided with a semi-cylindrical shroud extending from the shell housing and which is arranged and configured to allow fuel flow to reach the sparking area with an improved tumble pattern. The shroud will incorporate advanced edge profiles such as, for example, chamfers and/or fillets, to prevent localized hot spots and aid in heat transfer.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected exemplary embodiments and not all possible implementations, and are not intended to limit the scope of the present disclosure.

DETAILED DESCRIPTION

Figure 1:
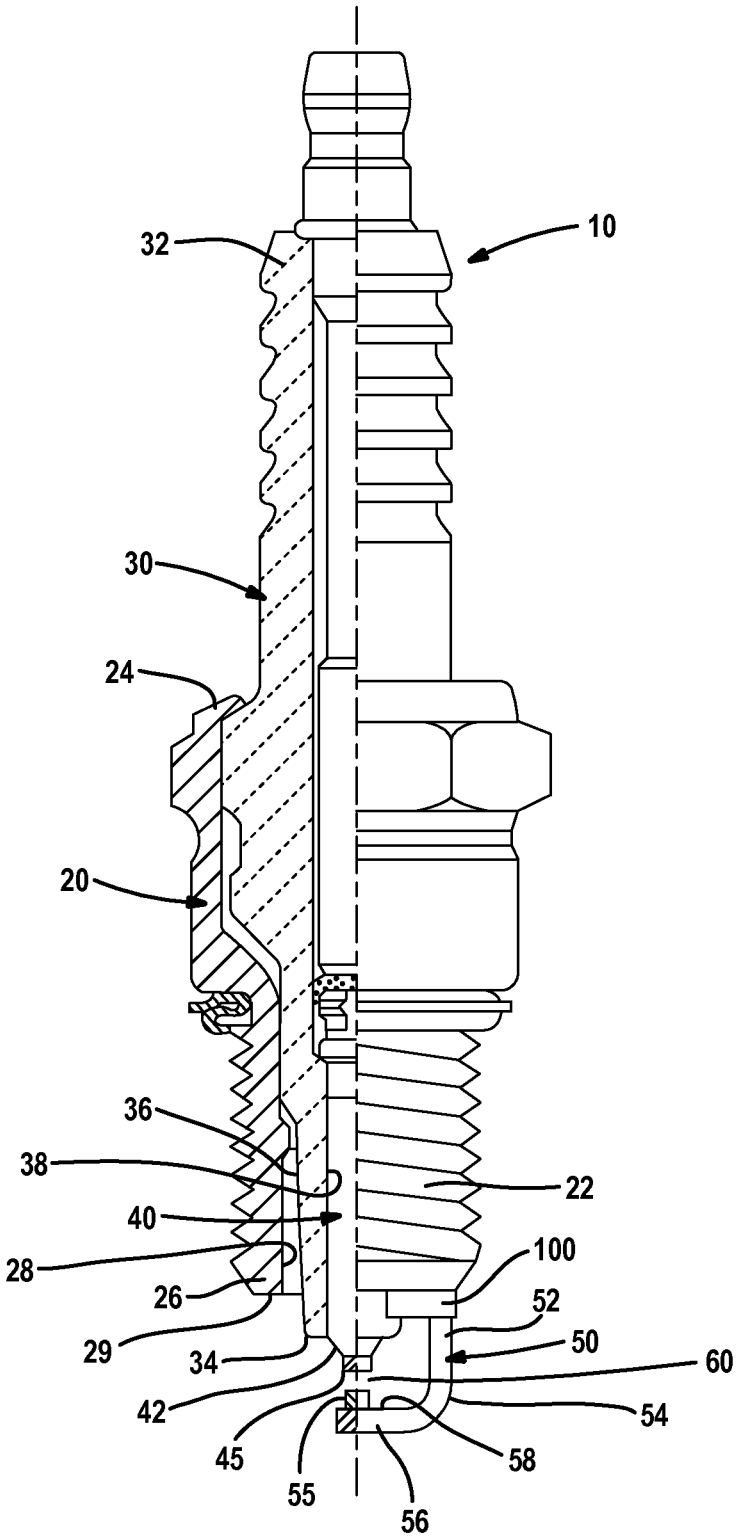
FIG. 1 is a partial cross-sectional view of a spark plug according to the teachings of the present disclosure.

Example embodiments will now be described more fully with reference to the accompanying drawings. It should be understood that throughout the drawings, corresponding reference numerals indicate like or corresponding parts and features. Example embodiments are provided so that this disclosure will be thorough, and will fully convey the scope to those who are skilled in the art. Numerous specific details are set forth such as examples of specific components, devices, and methods, to provide a thorough understanding of the exemplary embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies may not be described in detail.

FIG. 1 shows an overall structure of a spark plug 10 according to a first exemplary embodiment of the present disclosure. The spark plug 10 is designed for use with internal combustion engines of the type used in automotive vehicles. When installing the spark plug 10 to an internal combustion engine, it is inserted into a combustion chamber through a threaded bore provided in the engine block which forms the combustion chamber together with other components of the engine, such as the cylinder and piston.

The spark plug 10 generally includes a metallic shell housing 20, an insulator 30, a center electrode 40, a ground electrode 50, a first noble metal chip 45, and a second noble metal chip 55. The metal shell housing 20 can be made of an electrically conductive material, such as, for example, a low-carbon steel. The metal shell housing 20 can be a tubular or hollow structure having a threaded portion 22 on its outer periphery for fitting the spark plug 10 into the threaded bore of the engine block. The shell housing 20 is configured to withstand the torque of tightening the spark plug 10 into the engine block, remove excess heat from the spark plug 10, and transfer the excess heat to the engine block.

The insulator 30 can be installed in the hollow shell housing 20 and is fixedly and coaxially supported therein along a central axis Y. The insulator 30 can be made of a porcelain material such as, for example, alumina ceramic. The insulator 30 may include a first or distal end 32 that protrudes outwardly from an upper end portion 24 of the shell housing 20 and second or proximal end 34 that protrudes outwardly from a cylindrical lower end portion 26 of the shell housing 20. The length of the insulator 30 can be selected to provide an appropriate length for the spark plug 10. Furthermore, an annular air pocket is formed between an inner peripheral surface 28 of the shell housing 20 and an outer peripheral surface 36 of the insulator 30.

The insulator 30 can have an axial bore 38 for fixedly retaining and encircling the center electrode 40 in an electrically insulated state and which also extends along the central axis Y. A proximal end portion 42 of the center electrode 40 may protrude from the proximal end 34 of the insulator 30 such that the center electrode 40 protrudes a predetermined distance from a terminal end surface 29 of the shell housing 20. The first noble metal chip 45 is secured (i.e., welded) to the proximal end portion 42 of the center electrode 40. The cylindrically-shaped center electrode 40 can be made to include a highly heat conductive core material and a highly heat resistant and corrosion-resistant cladding material.

As will be detailed hereinafter in greater detail, the ground electrode 50 may be joined to and extend from a shroud member 100 which extends downward from the terminal end surface 29 of the shell housing 20. The ground electrode 50 may take the form of a rectangular columnar configuration having a first portion 52 secured to the shroud member 100 extending from the shell housing 20, a second portion 54 bent in a substantially orthogonal configuration, and a third portion 56 laterally extending from the second portion 54. It is contemplated that the first portion 52 can be welded to a terminal end surface 102 of the shroud member 100 for securing the ground electrode 50 to the shell housing 20. As seen, the second noble metal chip 55 can be secured (i.e., welded) to a face surface 58 on the third portion 56 of the ground electrode 50 and is aligned relative to the first noble metal chip 45. A predetermined spark gap 60 is established between the first noble chip 45 and the second noble metal chip 55.

It is contemplated that the first and second noble metal chips 45 and 55 can be joined to the center and ground electrodes 40 and 50, respectively, using any suitable joining methodology such as laser welding, plasma welding, resistance welding and suitable adhesives. Likewise, the first portion 52 of the ground electrode 50 can be joined to the terminal end surface 102 of the shroud member 100 using any suitable joining methodology.

Figure 2A:
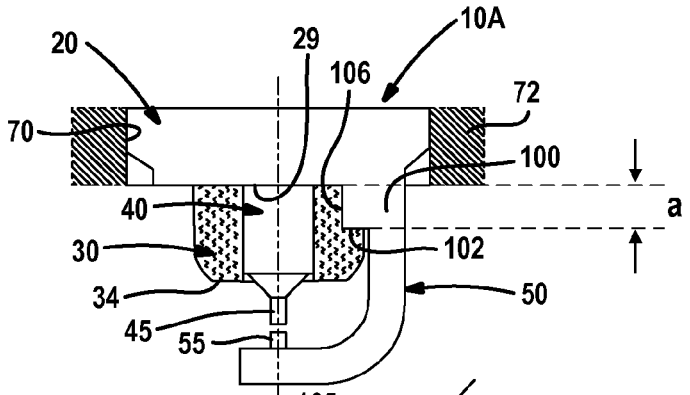
FIGS. 2A through 2C are partial sectional views of the spark plug shown in FIG. 1 which illustrate different partial shroud configurations according to the present disclosure.
Figure 3A:
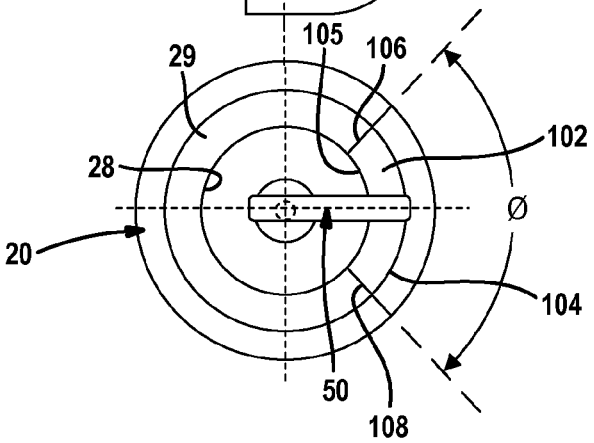
FIGS. 3A through 3C are bottom views of the spark plugs shown in FIGS. 2A through 2C.
Figure 4A:
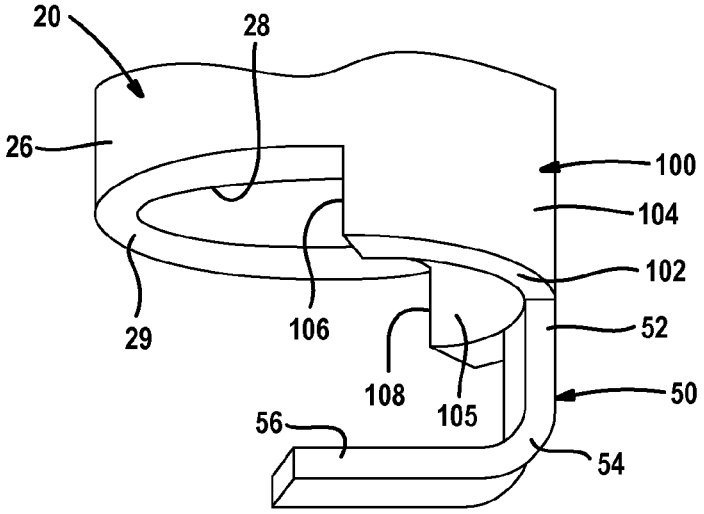
FIGS. 4A through 4C are partial perspective views of the shell housing associated with the partially-shrouded spark plugs of FIGS. 2A through 2C.

Referring particularly to FIGS. 2A, 3A and 4A, a first exemplary embodiment of a partially-shrouded spark plug 10A is shown installed in a threaded bore 70 formed in the engine block 72 to extend into the combustion chamber and which is constructed in accordance with the present teachings. The shroud member 100 extends downwardly from the terminal end surface 29 of the shell housing 20 and can be configured as a semi-cylindrical housing extension having an outer arcuate surface 104 and an inner arcuate surface 105 that are bounded by the terminal end surface 102 and a pair of transverse edge surfaces 106 and 108. The terminal end surface 29 of the shell housing 20 and the terminal end surface 102 of the shroud member 100 are coaxially oriented and concentrically aligned relative to the center Y axis.

The semi-cylindrical shroud member 100 extends an arcuate length having an angular dimension (Ø°) which can be selected to meet specific operating and durability characteristics for the spark plug 10A. In the first exemplary embodiment shown in FIGS. 2A, 3A and 4A, the shroud member 100, formed by the cylindrical housing extension, is configured to extend about 90° to define a partially-shrouded shell housing. In addition, the shroud member 100 extends downwardly an axial distance "a" that is measured between the terminal end surface 29 of the shell housing 20 and the terminal end surface 102 of the shroud member 100. While the partial shroud 100 is shown to be generally symmetrically oriented in relation to the ground electrode 50 and the center axis Y, it is understood that non-symmetrically orientations for the partial shroud 100 are also contemplated and capable of use with the spark plugs of the present disclosure.

Figure 2B:
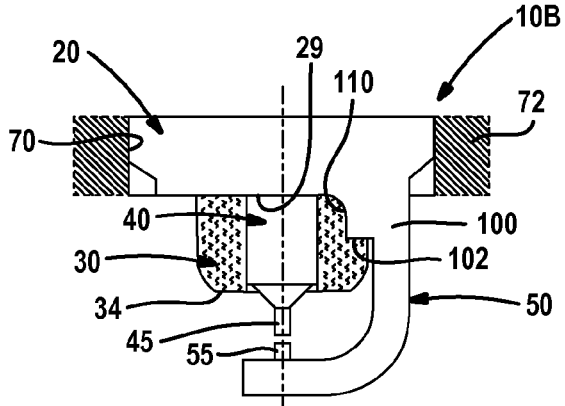
Figure 3B:
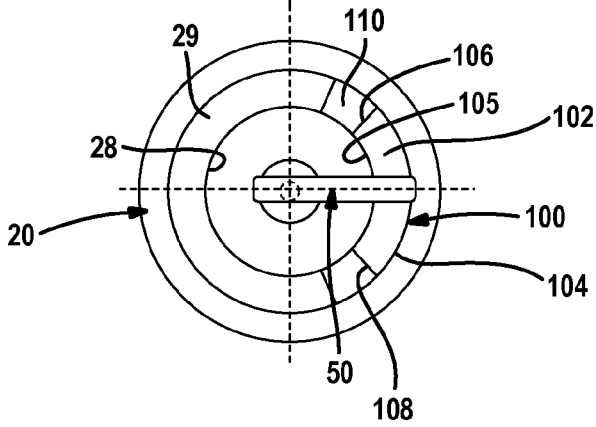
Figure 4B:
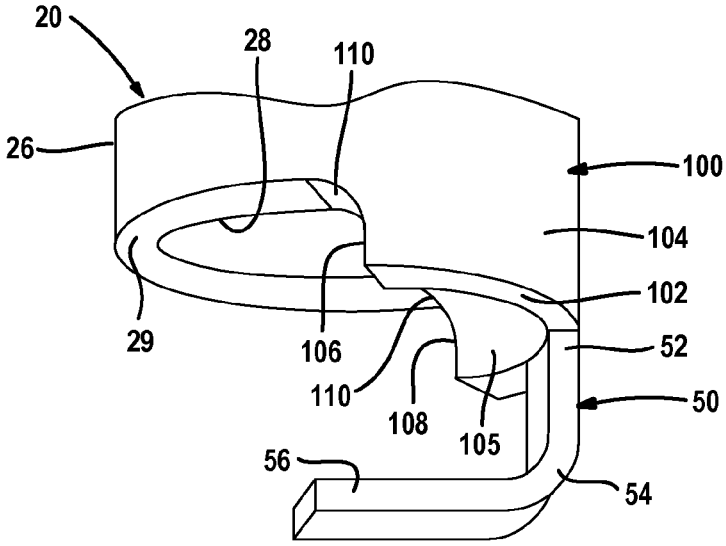

Referring now specifically to FIGS. 2B, 3B and 4B, a second exemplary embodiment of a partially-shrouded spark plug 10B is shown installed in the threaded bore 70 of the engine block 72. Spark plug 10B is generally similar to spark plug 10A but further includes transverse arcuate end surfaces, hereinafter referred to as fillets 110, formed at the interface between the terminal end surface 29 of the shell housing 20 and each of the lateral edge surfaces 106 and 108 of the semi-cylindrical shroud member 100. The use of fillets 110 can assist in preventing the creation of localized hot spots on the shroud member 100 and/or the shell housing 20, can reduce sharp edges, and can further aid in improved heat transfer.

Figure 2C:
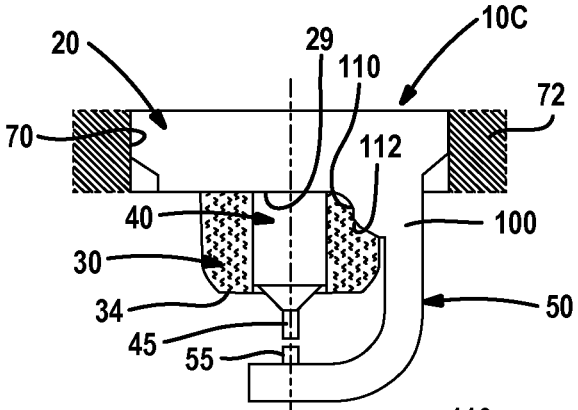
Figure 3C:
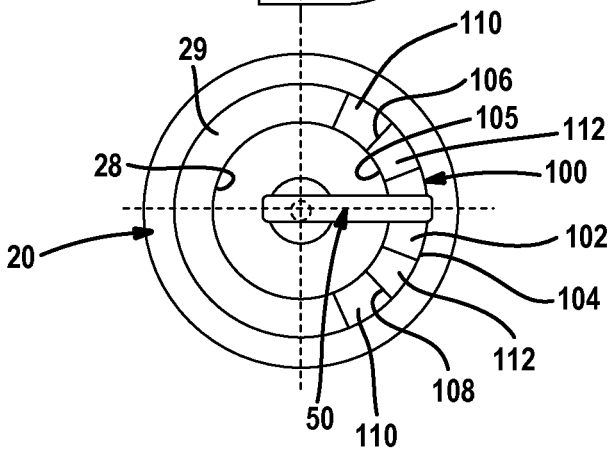
Figure 4C:
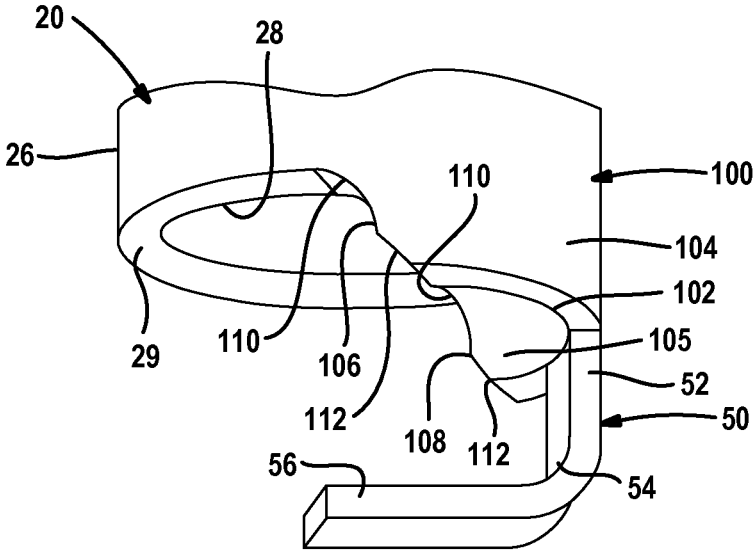

Referring now to FIGS. 2C, 3C and 4C, a third exemplary embodiment of a partially-shrouded spark plug 10C is shown installed in the threaded bore 70 of the engine block 72. Spark plug 10C is generally similar to spark plug 10B but further includes transverse linear edge surfaces, hereinafter referred to as chamfers 112, formed at the interface between the lateral edges surfaces 106, 108 and the terminal end surface 102 of the shroud member 100. The combination of fillets 110 and chamfers 112 are provided to further aid in promoting improved heat transfer and reduce potential hotspots associated with sharp edges.

As noted, the arcuate length (Ø°) of the shroud member 100 extending from the shell housing 20 can be selected to inhibit undesirable pre-ignition events while promoting a more complete burn. The shroud members 100 associated with spark plugs 10A, 10B, and 10C have been illustrated for exemplary purposes only, to extend less than 180° and more specifically about 90°. Referring now to FIGS. 5 and 6, additional alternative exemplary embodiments of partially-shrouded spark plugs having shroud members with larger arc lengths will be shown and described.

Figure 5A:
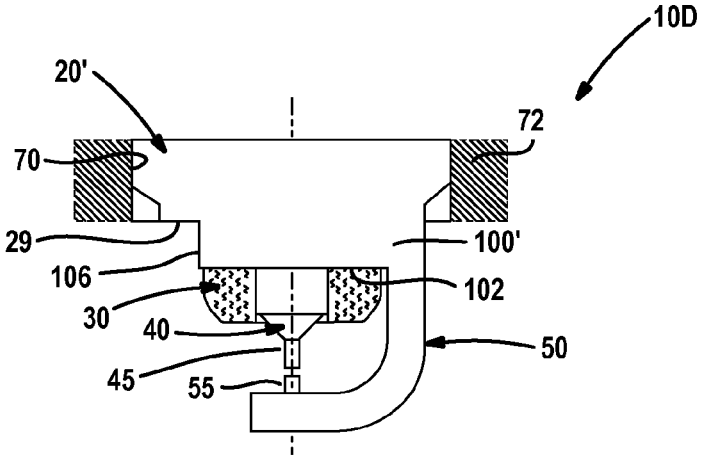
FIGS. 5A through 5E are partial sectional views of the spark plug shown in FIG. 1 illustrating additional alternative partial shroud configurations according to the present disclosure.
Figure 5B:
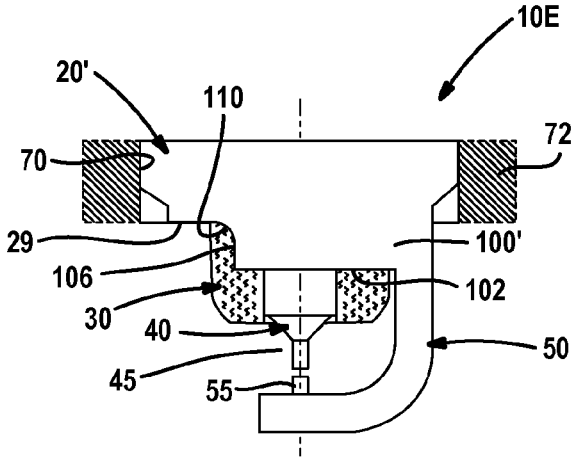
Figure 5C:
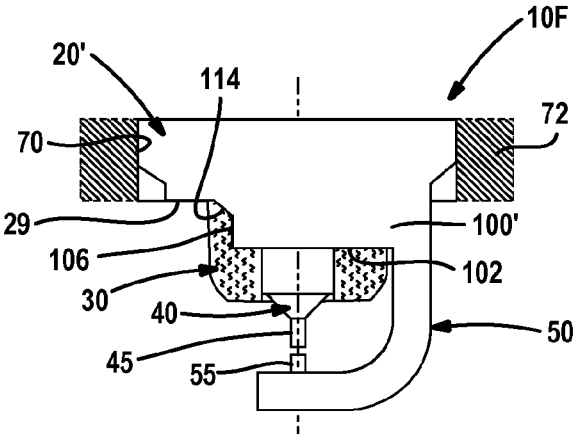
Figure 5D:
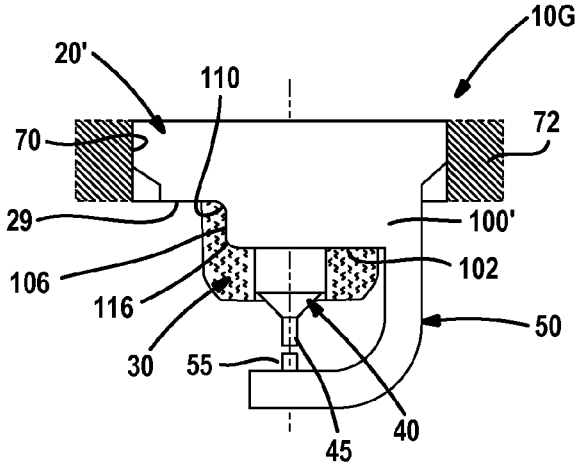
Figure 5E:
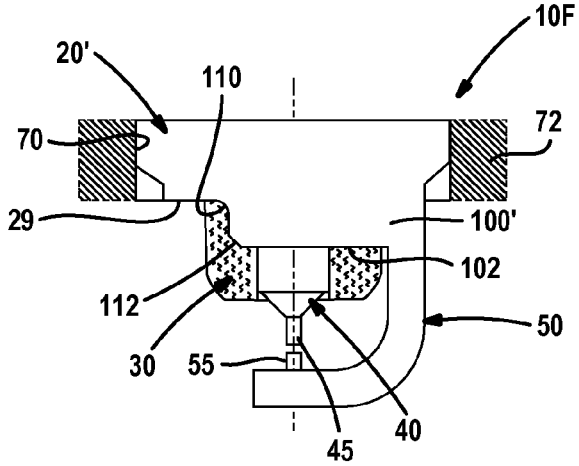
Figure 6:
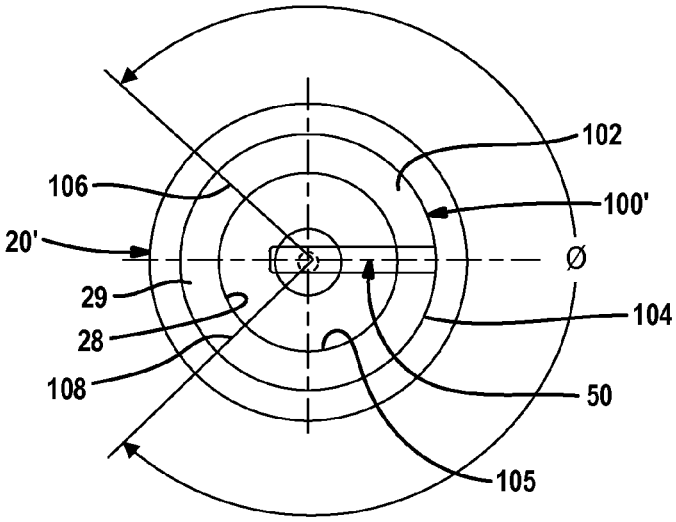
FIG. 6 is a bottom view of the partially-shrouded spark plug shown in FIG. 5A.

Referring to FIGS. 5 and 6, a partially-shrouded spark plug 10D is shown in FIG. 5A to include a shell housing 20' having a shroud member 100' which extends an arc length having an angular dimension of about 270°. Thus, spark plug 10D is generally similar to spark plug 10A of FIG. 2A except that a longer cylindrical shroud portion 100' is associated with the shell housing 20'. FIG. 5B shows a partially-shrouded spark plug 10E having a shroud member 100' configured to include chamfers 110 between the terminal end surface 29 of the shell housing 20' and the lateral edge surfaces 106 and 108 of the shroud member 100'. FIG. 5C shows a partially-shrouded spark plug 10F having its shroud member 100' configured to include chamfers 114 between the terminal end surface 29 of the shell housing 20' and the lateral edges surfaces 106 and 108. FIG. 5D illustrates a partially-shrouded spark plug 10G having fillets 110 between the terminal end surface 29 of the shell housing 20' and the lateral edges 106 and 108 as well as fillets 116 between the lateral edges 106 and 108 and the end surface 102 of the shroud member 100'. Finally, FIG. 5E illustrates a partially-shrouded spark plug 10H that is generally similar to spark plug 10C of FIG. 2C except that the shroud portion 100' has a longer arc length.

As noted, the angular length (Ø°) of the shroud portions 100 and 100' can be selected to promote the delivery of the air-fuel mixture into the spark area in and around the spark gap 60 while promoting improved mass heat transfer characteristics. Specifically, the tumble and/or swirl pattern of the air-fuel mixture is not detrimentally affected by the integration of the partial shrouds 100 and 100' into the spark plugs. It is contemplated that the partial shrouds 100 and 100' can be formed integrally with the shell housing 20 and 20' or, in the alternative, the partial shrouds 100 and 100' can be formed as an independent semi-cylindrical component that is joined to the terminal end surface 29 of a non-shrouded shell housing. In such a scenario, the separate shroud component can be made of a different material than the non-shrouded shell housing if desired to modify the heat transfer characteristics.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A spark plug, comprising:

a metallic shell housing having a terminal end surface;

an insulator disposed within said shell housing and having an end portion protruding from said terminal end surface;

a center electrode disposed within said insulator and having a tip portion protruding from said end portion of said insulator;

a shroud extending from said shell housing and configured to partially surround said insulator, said shroud having an end surface interconnected to said terminal end surface of said shell housing by a pair of laterally-spaced edge surfaces; and a ground electrode having a first end portion joined to said end surface of said shroud and a second end portion extending transversely relative to said first end portion so as to be facing and aligned with said tip portion of said center electrode; wherein said shell housing has a cylindrical lower portion defining its terminal end surface, and wherein said shroud is a circular semi-cylindrical extension of said cylindrical lower portion of said shell housing and which extends downward from said terminal end surface of said shell housing.

2. The spark plug of claim 1 wherein said circular semi-cylindrical shroud is a semi-annular shroud.

3. The spark plug of claim 1 wherein said end surface of said shroud is aligned generally parallel to said terminal end surface of said shell housing.

4. The spark plug of claim 1 wherein said shroud further includes a transverse surface formed at the interface between said terminal end surface of said shell housing and each of said lateral edge surfaces.

5. The spark plug of claim 4 wherein said transverse surface is arcuate so as to form a fillet between said terminal end surface of said shell housing and said of each lateral edge surfaces of said shroud.

6. The spark plug of claim 4 wherein said transverse surface is linear so as to form a chamfer between said terminal end surface of said shell housing and each of said lateral edge surfaces of said shroud.

7. The spark plug of claim 4 wherein said shroud further includes a second transverse surface formed at the interface between each of said lateral edge surfaces and said end surface of said shroud.

8. The spark plug of claim 1 wherein said shroud further includes a transverse surface formed at the interface between each of its lateral edge surfaces and its end surface.

9. The spark plug of claim 1 wherein said circular semi-cylindrical shroud which extends through an arc of about 90° to 270° such that said shroud does not completely encircle said insulator and said center electrode.

10. The spark plug of claim 1 wherein said shroud is integrally formed with said shell housing and its lateral edge surfaces are generally orthogonally oriented relative to said terminal end surface of said shell housing and said end surface of said shroud.

11. The spark plug of claim 1 wherein said shroud is joined to said terminal end surface of said shell housing and to which the first end portion of the ground electrode is joined.

12. A spark plug, comprising:

a hollow metallic shell housing defining a cylindrical lower portion having a first terminal end surface and a circular semi-cylindrical shroud extending from said first terminal end surface and having a second terminal end surface;

an insulator disposed within said shell housing and having an end portion protruding from said second terminal end surface of said shroud;

a center electrode disposed within said insulator and having a tip portion protruding from said end portion of said insulator; and a ground electrode having a first end portion joined to said second terminal end surface of said shroud and a transverse second end portion facing and aligned with said tip portion of said center electrode to define a sparking area therebetween.

13. The spark plug of claim 12 wherein said shroud includes a pair of laterally-spaced edge surfaces which interconnect said first and second terminal end surfaces.

14. The spark plug of claim 13 wherein said shroud further includes transverse surfaces formed at the interface between said first terminal end surface and said lateral edge surfaces.

15. The spark plug of claim 14 wherein said shroud further includes second transverse surfaces formed at the interface between said lateral edge surfaces and said second terminal end surface.

16. The spark plug of claim 13 wherein said shroud further includes transverse surfaces formed at the interface between said lateral edge surfaces and said second terminal end surface.

17. The spark plug of claim 12 wherein said circular semi-cylindrical shroud extends through an arc of between 90° and 270° such that said shroud does not completely encircle said insulator and said tip portion of said center electrode.

18. The spark plug of claim 12 wherein said shroud is formed integrally with said shell housing.

19. The spark plug of claim 12 wherein said shroud is fixedly joined to said first terminal end surface of said shell housing.

20. The spark plug of claim 12 wherein said circular semi-cylindrical shroud is a semi-annular shroud.

* * * * *